United States Patent [19]

Suprapto

[11] 4,173,875

[45] Nov. 13, 1979

[54] WASHING MACHINE

[76] Inventor: Otmax Suprapto, 4/245 Cleveland St., Redfern, N.S.W., Australia

[21] Appl. No.: 920,957

[22] Filed: Jun. 30, 1978

[51] Int. Cl.[2] ..... D06F 39/08

[52] U.S. Cl. ..... 68/18 D; 68/208

[58] Field of Search ..... 68/18 D, 23.6, 23.7, 68/181 R, 208; 210/379; 134/155, 158

[56] References Cited

U.S. PATENT DOCUMENTS

| | | | |
|---|---|---|---|
| 2,126,365 | 8/1938 | Alexopoulos | 68/18 D |
| 2,313,928 | 3/1943 | Dyer | 210/379 X |
| 3,675,448 | 7/1972 | Smith | 68/208 |
| 3,772,902 | 11/1973 | Noguchi | 68/23.6 X |

*Primary Examiner*—Philip R. Coe

[57] ABSTRACT

A washing machine comprising a housing, an outer tub disposed in the housing, an inner tub disposed within the outer tub, an agitator disposed centrally of the inner tub and fixed to a vertical drive shaft, the inner tub having perforations in wall portions thereof, a first drain line extending from a bottom portion of the outer tub, an annular chamber disposed proximate an upper portion of the outer tub and positioned between the outer tub and a wall portion of the housing, the chamber having holes therein placing the chamber in communication with upper regions of the outer tub, and a second drain line extending from the annular chamber and connected to the first drain line.

2 Claims, 2 Drawing Figures

WASHING MACHINE

BACKGROUND OF THE INVENTION

1. Field of the Invention

This invention relates to automatic washing machines and is directed more particularly to such a machine having means for removal of scum floating on the surface of water therein.

2. Description of the Prior Art

Washing machines having means for removing scum from the surface of the water within the machine are generally known in the art. Examples of such devices may be seen in U.S. Pat. Nos. 2,126,365 issued Aug. 9, 1938 to D. G. Alexopoulos; 2,421,803 issued June 10, 1947 to D. R. Neal; and 3,675,448 issued July 11, 1972 to J. H. Smith.

In spite of the above advances, there still exists a need for a washing machine having reliable and efficient means for removing scum from the water therein and having a facility for directing such collected material to the main drain line of the machine.

SUMMARY OF THE INVENTION

An object of the present invention is to provide a washing machine having a facility for removing undesirable elements floating on the surface of the water therein.

With the above and other objects in view, as will hereinafter appear, a feature of the present invention is a provision of a washing machine comprising a housing, an outer tub disposed in the housing, an inner tub disposed within the outer tub, an agitator disposed centrally of the inner tub and fixed to a vertical drive shaft, the inner tub having perforations in wall portions thereof, a motor disposed in the housing and operative to drive the drive shaft, a first drain line extending from a bottom portion of the outer tub, a pump in communication with the first drain line and operative to move liquid through the first drain line, an annular chamber disposed proximate an upper edge of the outer tub and positioned between the outer tub and a wall portion of the housing, the chamber having holes therein placing the chamber in communication with upper regions of the outer tub, and a second drain line extending from the annular chamber and connected to the first drain line.

In accordance with a further feature of the invention, the annular chamber is provided with a floor portion which is inclined, the second drain line having an opening at a lowest point of the floor portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
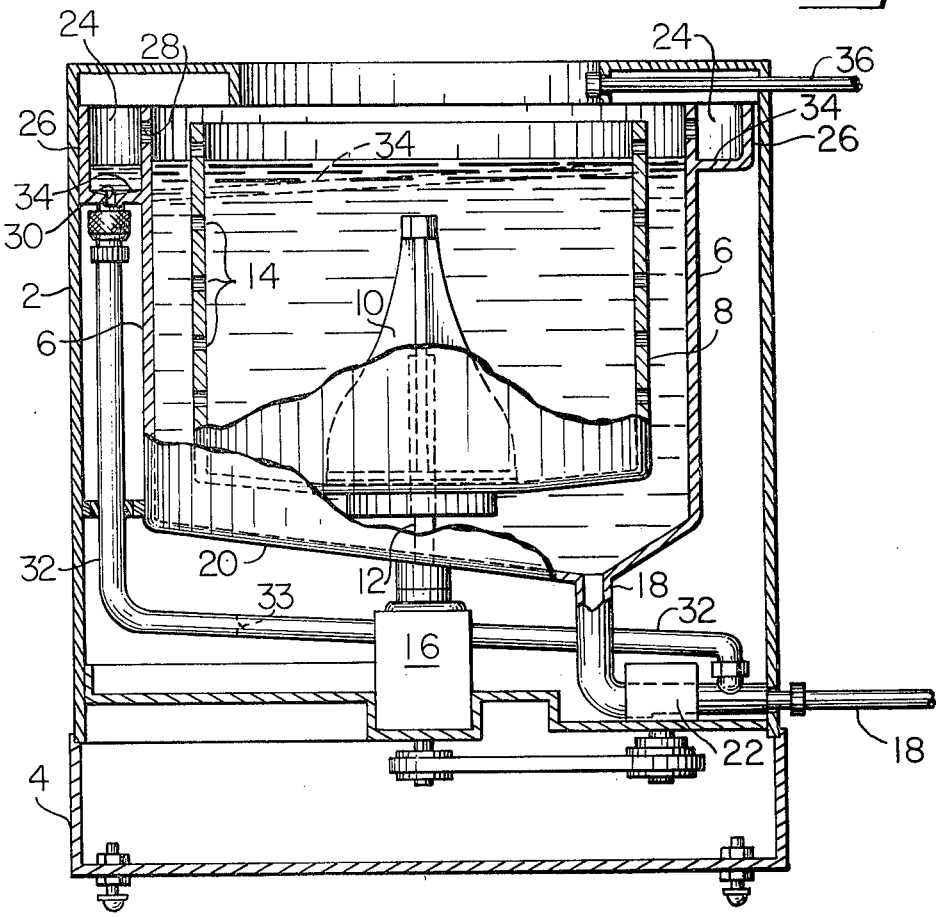
FIG. 1 is an elevational sectional view of a washing machine illustrative of an embodiment of the invention.
Figure 2:
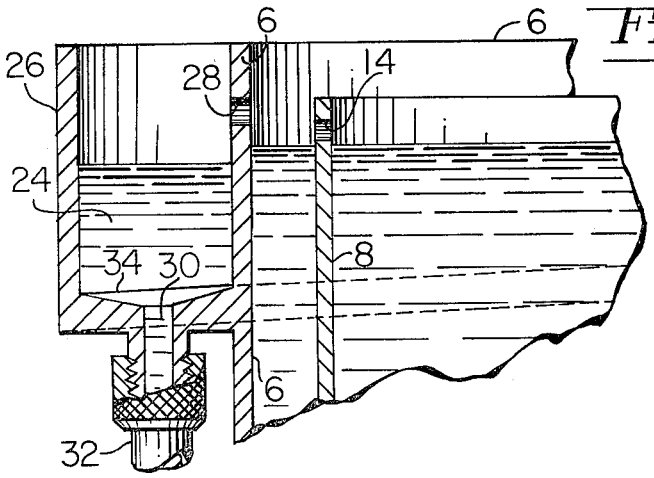
FIG. 2 is an enlarged sectional view of a portion of the machine of FIG. 1.

Referring to the drawings, it will be seen that the illustrative washing machine includes a housing 2 disposed upon a frame 4. An outer tub 6 is disposed within the housing 2 and an inner tub 8 is disposed within the outer tub 6. An agitator 10 is located centrally of the inner tub 8 and fixed to a vertical drive shaft 12. The inner tub 8 is provided with a multiplicity of perforations 14 in wall portions thereof. A motor 16 is disposed in the housing 2 and is operative to drive the drive shaft 12.

A first drain line 18 extends from a bottom portion 20 of the outer tub 6. A pump 22, driven by the motor 16, is in communication with the first drain line 18 and is operative to move liquid through the first drain line.

An annular chamber 24 is disposed proximate an upper edge portion of the outer tub 6 and is defined by a wall portion 26 and an upper portion of the outer tub 6. Hole means 28 are provided in tub 6, the hole means 28 placing the chamber 24 in communication with upper regions of the outer tub.

The hole means 28 are positioned at the water level height of water in the machine during a washing operation. The chamber 24 is further provided with opening means 30 in communication with a second drain line 32 extending downwardly from the chamber 24 and connected to the first drain line 18.

In the second drain line 32 there is disposed a one-way valve 33 permitting downward flow through the line but obstructing flow in the reverse direction.

The chamber 24 is provided with a floor portion 34, the opening means 30 being at a lowest point of the floor portion 34.

A water inlet 36 extends from outside the tub 6 and is operable to direct fresh water into the machine.

In operation, the machine operates in much the same manner as an ordinary vertical type washing machine. However, with the addition of the annular chamber 24, the scum floating on the surface of the water in the machine is continually drawn through the hole means 28 into the chamber 24 and through the opening means 30 into the second drain line 32, past the valve 33, and into the first drain line 18. Thus, upon completion of a washing cycle, it is not necessary that the scum floating on the surface of the water be drained down through the contents of the machine to the first drain line 18. Instead, such floating scum is removed from the surface of the water without having to come in contact with the materials being cleansed in the machine.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A washing machine comprising a housing, a generally cylindrically-shaped outer tub disposed in said housing, an inner tub disposed within said outer tub, a vertical drive shaft disposed centrally of said inner tub, an agitator fixed to said vertical drive shaft, said inner tub having upstanding wall portions generally cylindrically-shaped and disposed generally concentrically of said outer tub, said wall portions having perforations therein, a motor disposed in said housing and operative to drive said drive shaft, said outer tub having an inclined bottom surface having a lowest point, a first drain line extending from said bottom surface lowest point of said outer tub, a pump in communication with said first drain line, said motor being operative to drive said pump, said pump being operative to move liquid through said first drain line, said outer tub having an open upper end forming a circular upper edge, a floor fixed to and extending outwardly from said outer tub and generally normal thereto, an upstanding circular wall fixed to an outer circular edge of said floor to define an annular open-top chamber bounded by said outer tub cylindrical wall and said upstanding circular wall, said outer tub cylindrical wall having holes therein placing said chamber in communication with upper regions of said outer tub, said floor of said chamber being inclined in its extent about said outer tub to define a chamber lowest point, a second drain line extending from said annular chamber lowest point and connected to said first drain line, and a one-way valve disposed in said second drain line and permitting flow from said chamber lowest point to said first drain line.

2. The invention in accordance with claim 1 in which said floor and said upstanding circular wall are integral with said outer tub.

* * * * *